US006302648B1

(12) United States Patent
Konishi et al.

(10) Patent No.: US 6,302,648 B1
(45) Date of Patent: Oct. 16, 2001

(54) STEAM TURBINE JOINTED STATIONARY BLADE

(75) Inventors: Tetsu Konishi; Keizo Tanaka; Hideyuki Toda; Asaharu Matsuo; Toyokazu Kuwana; Ryotaro Magoshi, all of Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/427,092

(22) Filed: Oct. 26, 1999

(51) Int. Cl.[7] ..... F01D 9/00

(52) U.S. Cl. ..... 415/193; 415/209.1; 415/209.3

(58) Field of Search ..... 415/191, 193, 415/209.1, 209.3

(56) References Cited

U.S. PATENT DOCUMENTS

| | | | | |
|---|---|---|---|---|
| 2,445,661 | * | 7/1948 | Constant et al. | 415/209.3 |
| 2,625,367 | * | 1/1953 | Rainbow et al. | 415/209.3 |
| 4,218,180 | * | 8/1980 | Wikstrom | 415/138 |
| 4,435,121 | | 3/1984 | Wosika . | |
| 4,502,838 | | 3/1985 | Miller et al. . | |
| 4,816,213 | | 3/1989 | Groenendaal, Jr. . | |
| 4,875,828 | * | 10/1989 | Willkop et al. | 415/173.4 |
| 4,900,223 | | 2/1990 | Groenendaal, Jr. . | |
| 5,149,248 | | 9/1992 | Cramer . | |
| 5,308,227 | * | 5/1994 | Gros et al. | 416/219 R |
| 5,743,711 | | 4/1998 | Fournier et al. . | |

FOREIGN PATENT DOCUMENTS

| | | |
|---|---|---|
| 195 27 662 | 1/1997 | (DE) . |
| 93/20334 | 10/1993 | (WO) . |

* cited by examiner

*Primary Examiner*—Edward K. Look
*Assistant Examiner*—Ninh Nguyen

(57) ABSTRACT

A two stage jointed stationary blade of a high pressure or intermediate pressure steam turbine is formed with a bolt joint in place of a welded joint so as to make detachment and disassembly possible, and thereby facilitating maintenance and inspection work and reducing assembling man-hours. A stationary blade (front stage)(2), outer ring front portion (1) and inner ring front portion (3) are welded into an integral structure. A stationary blade (rear stage) 22, outer ring rear portion (21) and inner ring rear portion (23) are also welded into an integral structure. The outer ring front portion 1, outer ring center portion 10 and the outer ring rear portion 21 are mutually engaged via engaging portions (4, 11 and 12, 24) with precise positioning and then jointed together integrally by bolt (30). The two stage jointed stationary blade can be engaged with moving blades (33, 35), labyrinth seals (32, 34) can be fitted to seal fitting portions (6, 26), and seal fins (31, 34) can be fitted in seal fin grooves (13, 27).

5 Claims, 5 Drawing Sheets

STEAM TURBINE JOINTED STATIONARY BLADE

BACKGROUND OF THE INVENTION

1. Field of the Invention

The present invention relates generally to a jointed stationary blade of a steam turbine and more particularly to a two stage jointed stationary blade, applicable to a high pressure or intermediate pressure steam turbine, in which an outer ring for jointing a front stage stationary blade and a rear stage stationary blade together fixedly is made in a bolt joint structure so as to be detached and disassembled easily thereby to have a reduced assembling man-hour and an enhanced maintainability.

2. Description of the Prior Art

In a high pressure or intermediate pressure steam turbine, trials are being performed using a two stage jointed stationary blade in which mutually adjacent front stage and rear stage stationary blades are fixedly jointed together. FIG. 4 is a cross sectional view of such a two stage jointed stationary blade after it has been assembled and FIGS. 5(*a*)–(*b*) are cross sectional views of two stationary blade structural portions before they are assembled. In particular, FIG. 5(*a*) shows a stationary blade (front stage) portion and FIG. 5(*b*) shows a stationary blade (rear stage) portion.

In the prior art two stage jointed stationary blade shown in FIG. 5, a stationary blade (front stage) 42 on an upstream side of steam flow S is constructed as in an integral structure fitted with an outer ring front portion 41 and an inner ring front portion 43 fixedly by welding. A stationary blade (rear stage) 52 is also constructed as in an integral structure fitted with an outer ring rear portion 51 and an inner ring rear portion 53 fixedly by welding. These integral stationary blades 42, 52 are jointed together fixedly by electron beam welding at a position, indicated by numeral 70 (FIG. 4), of the outer ring front portion 41 and the outer ring rear portion 51, such that the two stage jointed stationary blade is an integral structure.

It is to be noted that seal fitting portions 44, 54 are formed for fitting thereto labyrinth seals in the inner ring front portion 43 and the inner ring rear portion 53, respectively. Also, seal fin grooves 55, 56 are formed in the outer ring rear portion 51, as will be described later.

In the integral structure of the stationary blade (front stage) 42 shown in FIG. 5(*a*), the outer ring front portion 41 is fitted to an outer side of the blade via welded portions 45, 46 and the inner ring front portion 43 is fitted to an inner side of the blade via welded portions 47, 48. Also, the seal fitting portion 44 for fitting thereto a labyrinth seal is worked in the inner ring front portion 43.

In the integral structure of the stationary blade (rear stage) 52 shown in FIG. 5(*b*), the outer ring rear portion 51 consists of portions 51*a*, 51*b*, 51*c*. The portions 51*a*, 51*b* are jointed together via welded portions 58, 59 and the portions 51*b*, 51*c* are jointed together via welded portions 56, 57, and the outer ring rear portion 51 is fitted to an outer side of the blade via welded portions 57, 59. Also, the inner ring rear portion 53 is fitted to an inner side of the blade via welded portions 60, 61. The seal fitting portion 54 for fitting thereto a labyrinth seal is formed in the inner ring rear portion 53. Furthermore, the seal fin grooves 55, 56 are worked in the outer ring rear portion 51. Thus, the respective integral structures of the stationary blade (front stage) 42 and the stationary blade (rear stage) 52 are jointed together by electron beam welding at the position 70, as shown in FIG. 4, thereby the two stage jointed stationary blade is constructed.

In the prior art two stage jointed stationary blade as described above, the respective integral structures of the outer ring, the stationary blade and the inner ring are made by TIG (tungsten inert gas) welding or MAG (metal active gas) welding and the front stage and rear stage structural bodies thereof are jointed together by electron beam welding at the position of the outer ring front portion and rear portion, and thereby the two stage jointed stationary blade is made as an integral structure. Therefore, the front stage and rear stage portions thereof cannot be separated from each other for a repair or inspection work, which results in making the work difficult. Also, the welding work itself requires a lot of man-hours, especially the jointing of the outer ring front portion 41 and the outer ring rear portion 51 requires welding around an entire periphery of the outer ring. Thus, there is a problem that large facilities of jigs, tools, etc. for performing the welding operation are needed and the necessary man-hours is also increased.

SUMMARY OF THE INVENTION

In view of the problem in the prior art, therefore, it is an object of the present invention to provide a steam turbine jointed stationary blade in which an outer ring front portion and an outer ring rear portion are jointed together in a bolt joint structure in place of the weld structure used in the prior art so as to be able to facilitate the repair or inspection work and to reduce the man-hours required to assemble the blade structure.

In order to achieve the mentioned object, the present invention provides the following arrangement.

That is, a steam turbine jointed stationary blade comprising a front stage stationary blade structural body and a rear stage stationary blade structural body. The front stage and rear stage stationary blade structural bodies are each constructed integrally by welding such that an outer ring of a stationary blade is jointed to an outer side of the stationary blade and an inner ring of the stationary blade is jointed to an inner side of the stationary blade. The structures are jointed together by the outer rings of the front stage and rear stage stationary blade structural bodies being jointed together are jointed together by a bolt.

In the jointed stationary blade of the present invention, the front stage and rear stage stationary blade structural bodies, each being made integrally, are jointed together by the bolt, and thereby detachment and disassemble thereof becomes possible and maintenance and inspection thereof can be easily performed. In the prior art jointed stationary blade, the front stage and rear stage stationary blade structural bodies are jointed together by electron beam welding so as to be fixedly integrated. This results in difficulty with respect to the detachment and disassembly required to perform the difficult work of maintenance and inspection and, furthermore, the electron beam welding, which must be done around the entire periphery of the outer ring, requires large facilities of jigs, tools, etc. and the manhours therefor also is increased. However, in the present invention, it is only necessary to install the bolt, and thus man-hours required for the assembly work can be reduced.

DESCRIPTION OF THE PREFERRED EMBODIMENT

Figure 1:
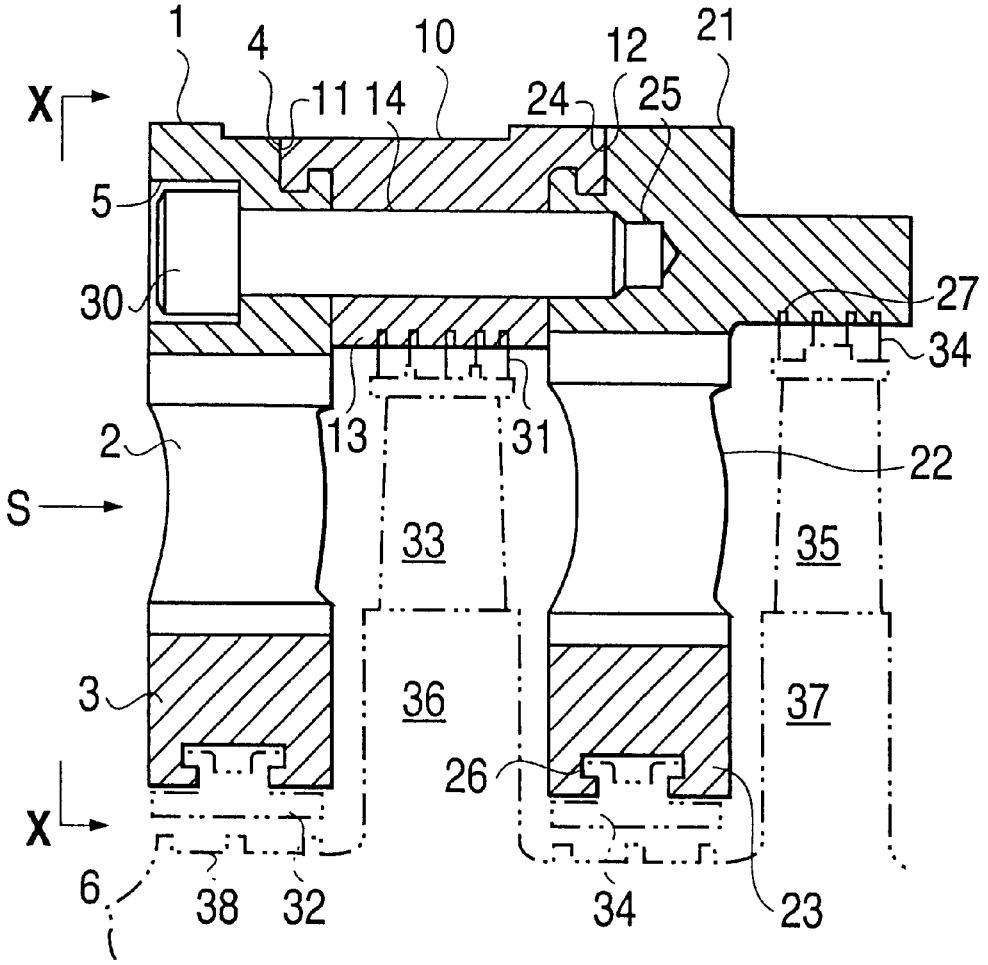
FIG. 1 is a cross sectional view of a steam turbine jointed stationary blade constructed in accordance with an embodiment of the present invention.
Figure 2:
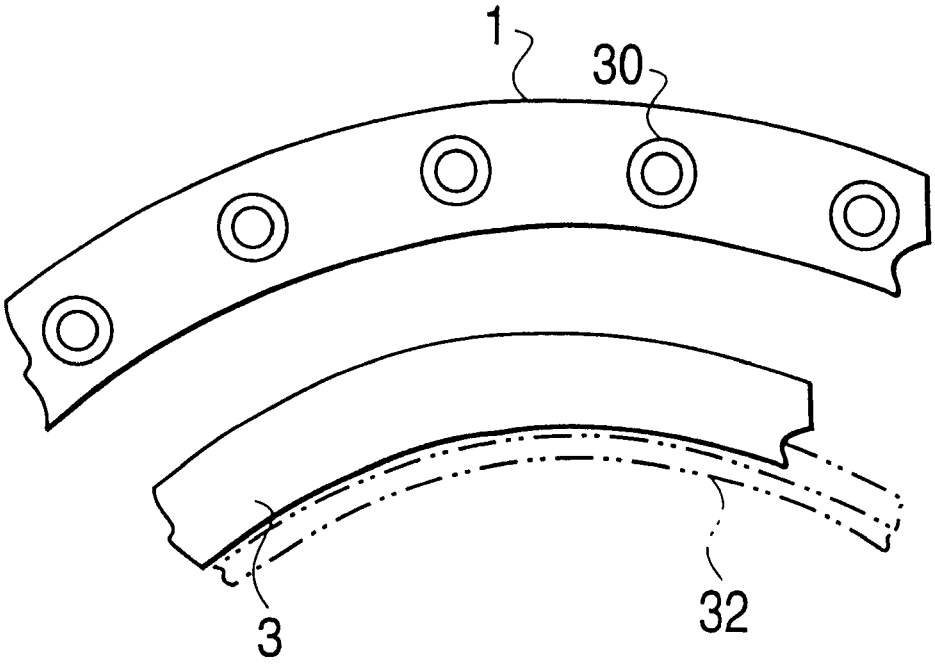
FIG. 2 is a partial front view as seen from plane X—X of FIG. 1.

Herebelow, an embodiment according to the present invention will be described in detail with reference to the drawing figures. FIG. 1 is a cross sectional view of a steam turbine jointed stationary blade of an embodiment according to the present invention. FIG. 2 is a partial front view as seen from plane X—X of FIG. 1, and FIGS. 3(*a*)–(*c*) are cross sectional views of three stationary blade structural portions before they are assembled, wherein FIG. 3(*a*) shows a stationary blade (front stage) portion, FIG. 3(*b*) shows an outer ring center portion and FIG. 3(*c*) shows a stationary blade (rear stage) portion.

Figure 3C:
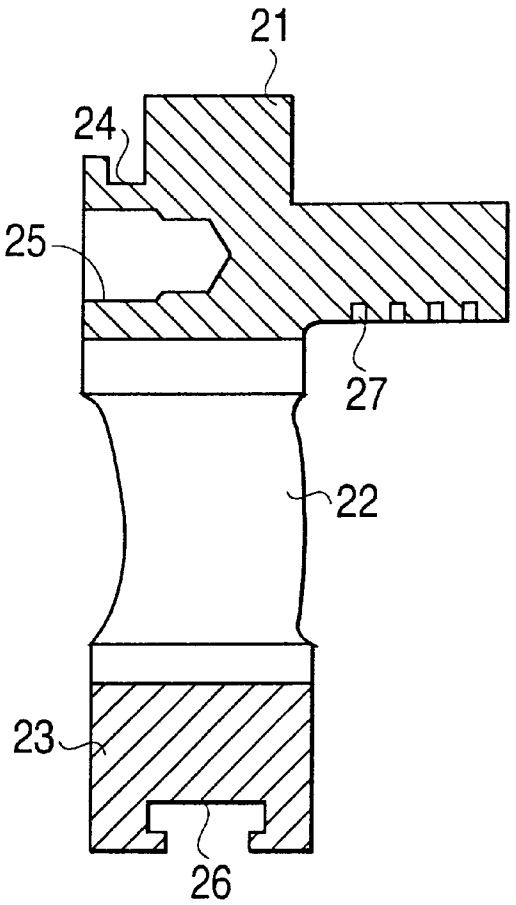
FIGS. 3(*a*)–(*c*) are cross sectional views of three stationary blade structural portions before they are assembled, wherein FIG. 3(*a*) shows a stationary blade (front stage) portion, FIG. 3(*b*) shows an outer ring center portion and FIG. 3(*c*) shows a stationary blade (rear stage) portion.
Figure 3B:
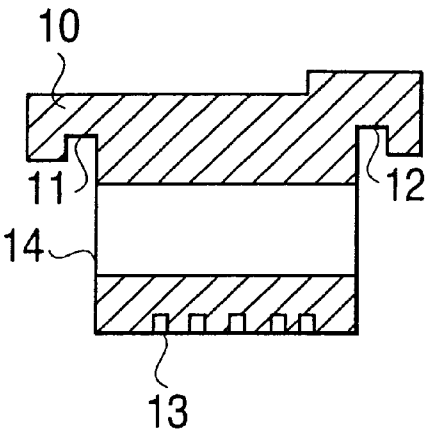
Figure 3A:
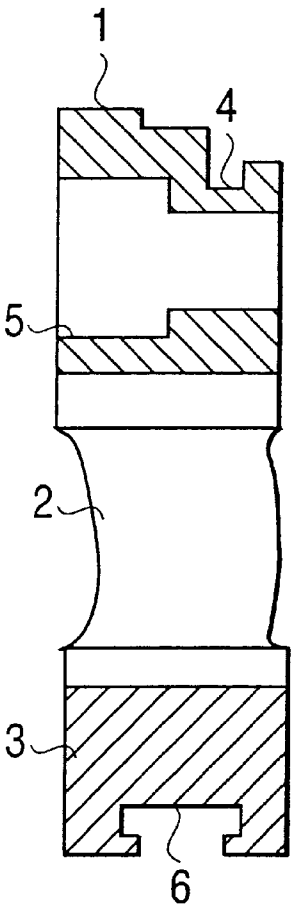
Figure 4:
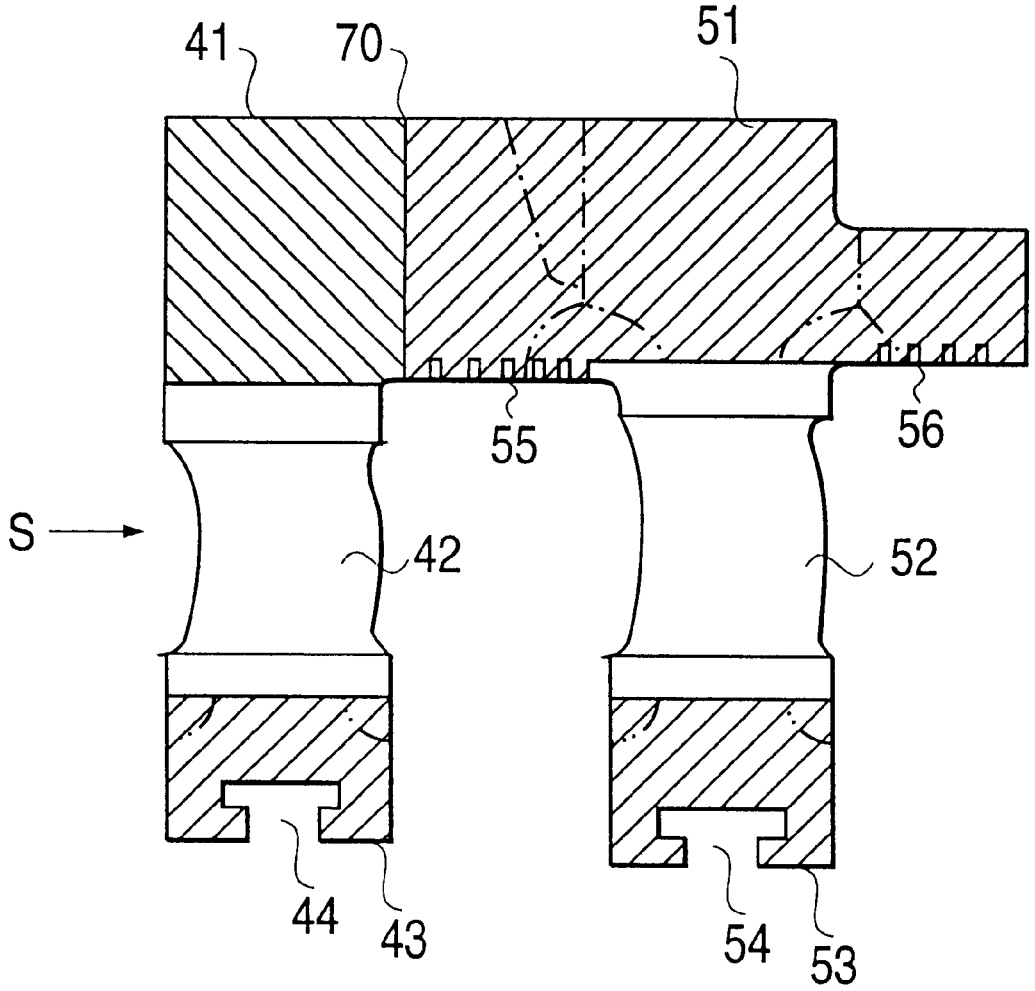
FIG. 4 (PRIOR ART)
FIG. 4 is a cross sectional view of a an assembled prior art steam turbine jointed stationary blade.
Figure 5B:
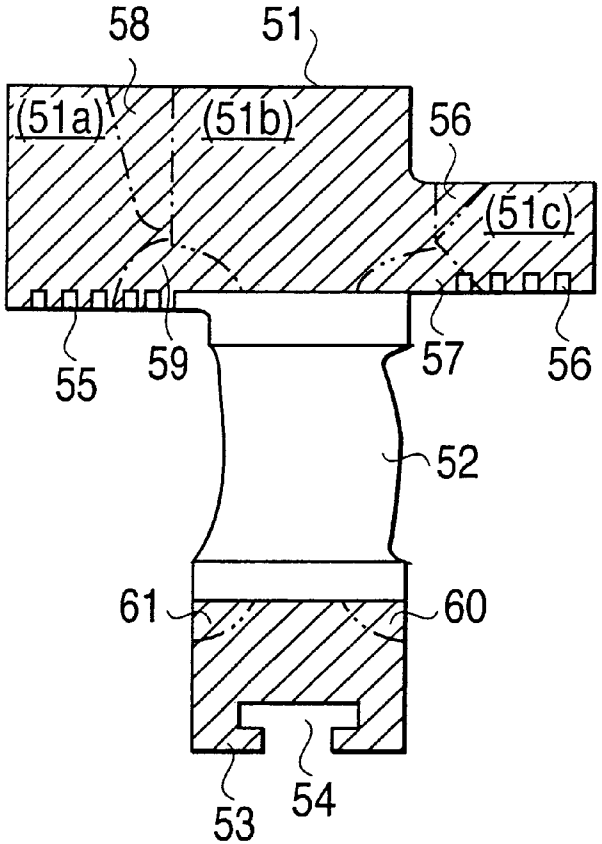
FIG. 5b (PRIOR ART)
FIGS. 5(*a*)–(*b*) are cross sectional views of two stationary blade structural portions before they are assembled, wherein FIG. 5(*a*) shows a stationary blade (front stage) portion and FIG. 5(*b*) shows a stationary blade (rear stage) portion.
Figure 5A:
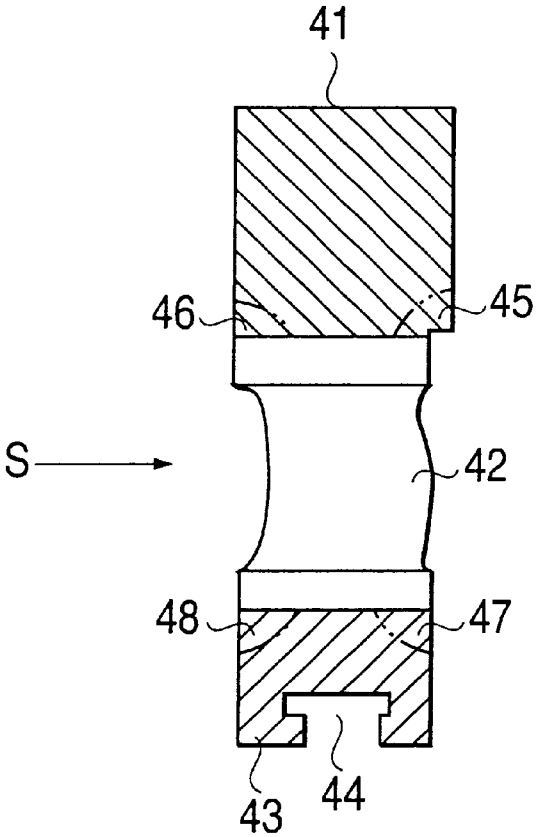
FIG. 5a (PRIOR ART)

In FIG. 3(*a*), like in the prior art case, an outer ring front portion 1 is jointed to an outer side of a stationary blade (front stage) 2 and an inner ring front portion 3 is connected to an inner side of the stationary blade (front stage) 2, so that an integral structure of the stationary blade (front stage) 2 is constructed. A seal fitting portion 6 for fitting thereto a labyrinth seal is formed in the inner ring front portion 3. A bolt hole 5, which can accommodate a bolt head portion, is formed in the outer ring front portion 1 and passes therethrough. In a right, or rear, end top portion of the outer ring front portion 1, an engaging portion 4 is formed in a stepped form for joint engagement with an end portion of an outer ring center portion 10 to be described next.

In FIG. 3(*b*), the outer ring center portion 10 has engaging portions 11, 12 formed in both end portions thereof, wherein the engaging portion 11 is for engaging the engaging portion 4 of the outer ring front portion 1 and the engaging portion 12 is for engaging an end portion of an outer ring rear portion 21 to be described below. A bolt hole 14 is provided in the outer ring center portion 10 and passes therethrough so as to communicate with the bolt hole 5 of the outer ring front portion 1. Further, seal fin grooves 13 are provided in the outer ring center portion 10.

In FIG. 3(*c*), an integral structure of a stationary blade (rear stage) 22 is shown, wherein an outer ring rear portion 21 is connected to an outer side of the stationary blade (rear stage) 22 by welding and an inner ring rear portion 23 is connected to an inner side of the stationary blade (rear stage) 22 by welding, similar to the prior art case. An engaging portion 24 is provided in a left, or front, end portion of the outer ring rear portion 21 for engaging the engaging portion 12 of the outer ring center portion 10. Also, a bolt hole 25 receiving a bolt end portion is formed in the outer ring rear portion so as to communicate with the bolt hole 14 of the outer ring center portion 10. A seal fitting portion 26 for fitting thereto a labyrinth seal is formed in the inner ring rear portion 23. Also, seal fin grooves 27 are provided in an inner periphery of a right, or rear, portion of the outer ring rear portion 21.

In FIG. 1, a cross section of a steam turbine two stage jointed stationary blade is shown, wherein each of the separated blade portions shown in FIG. 3 is connected together to form an integral structure of the steam turbine jointed blade. In FIG. 1, the outer ring front portion 1, the outer ring center portion 10 and the outer ring rear portion 21 are engaged with each other via two engagement portions, one being of the engaging portions 4, 11 and the other being of the engaging portions 12, 24, so that the bolt holes 5, 14, 25 can be easily aligned. In this state, a jointing bolt 30 is inserted and screwed into the bolt holes 5, 14, 25, thereby the portions 1, 10, 21 of the outer ring are strongly fastened together so as to be integrated into one unit.

In FIG. 2, which is a partial front view seen from plane X—X of FIG. 1, the outer ring front portion 1 is made in an annular form and a plurality of jointing bolts 30 are provided along the annular form for fastening the outer ring front portion 1, the outer ring center portion 10 and the outer ring rear portion 21 together strongly as mentioned above. It is to be noted that in the example illustrated in FIG. 2, an interval between each of the jointing bolts 30 is selected so that a central angle of the outer ring formed by the interval is set to 14 degrees (not shown), but the particular arrangement of the jointing bolts 30 is not limited thereto.

In the two stage jointed stationary blade having the jointing bolt 30 as shown in FIG. 1, the stationary blade (front stage) 2, a moving blade 33, the stationary blade (rear stage) 22 and a moving blade 35 are arranged sequentially in a direction of steam flow S, and a labyrinth seal 32 is fitted to the seal fitting portion 6 of the inner ring front portion 3 as well as a labyrinth seal 34 is fitted to the seal fitting portion 26, of the inner ring rear portion 23, thus a seal portion for sealing a rotor disc side is formed.

Further, seal fins 31 are fitted in the seal fin grooves 13 of the outer ring center portion 10 to form a seal portion for sealing a tip end portion of the moving blade 33 and seal fins 34 are fitted in the seal fin grooves 27 of the outer ring rear portion 21 to form a seal portion for sealing a tip end portion of the moving blade 35.

According to the jointed stationary blade of the present embodiment as described above, the outer ring is divided into the front portion 1, the center portion 10 and the rear portion 21. The outer ring front portion 1, the stationary blade (front stage) 2 and the inner ring front portion 3 are jointed together by welding to form an integral structure. The outer ring rear portion 21, the stationary blade (rear stage) 22 and the inner ring rear portion 23 are also jointed together by welding to form an integral structure. Also, the outer ring front portion 1, center portion 10 and rear portion 21 are fastened together strongly by the jointing bolt 30, thereby as compared with the prior art arrangement, detachment and disassembly are possible, maintenance is facilitated, and the man-hours needed to assemble the jointed blade can be reduced.

It is understood that the present invention is not limited to the particular construction and arrangement herein illustrated and described but embraces such modified forms thereof as come within the scope of the appended claims.

What is claimed is:

1. A steam turbine jointed stationary blade comprising:

a front stage stationary blade structural body comprising a front stage stationary blade, an outer ring connected to an outer side of said front stage stationary blade, and an inner ring connected to an inner side of said front stage stationary blade, wherein said outer and inner rings of said front stage stationary blade structural body are integrally connected to said front stage stationary blade by welding;

a rear stage stationary blade structural body comprising a rear stage stationary blade, an outer ring connected to an outer side of said rear stage stationary blade, and an inner ring connected to an inner side of said rear stage stationary blade, wherein said outer and inner rings of said rear stage stationary blade structural body are integrally connected to said rear stage stationary blade by welding; and an outer ring central member interposed between said outer rings of said front and rear stage stationary blade structural bodies, said outer ring central member having a front engaging portion and a rear engaging portion; and at least one bolt interconnecting said outer ring of said front stage stationary blade structural body, said outer ring central member and said outer ring of said rear stage stationary blade structural body, wherein said front engaging portion of said outer ring central member is engaged with said outer ring of said front stage stationary blade structural body in a hook-like fitted engagement, and said rear engaging portion of said outer ring central member is engaged with said outer ring of said rear stage stationary blade structural body in a hook-like fitted engagement.

2. A steam turbine jointed stationary blade as claimed in claim 1, wherein each of said outer rings of said front and rear stage stationary blade structural bodies defines a radially open engaging portion, and said front and rear engaging portions of said outer ring central member are received in said radially open engaging portions, respectively.

3. A steam turbine jointed stationary blade as claimed in claim 1, wherein said outer ring of said front stage stationary blade structural body includes a stepped portion defining an engaging portion, and said front engaging portion of said outer ring central member defines a stepped portion that is complementary to said stepped portion of said outer ring of said front stage stationary blade structural body.

4. A steam turbine jointed stationary blade as claimed in claim 1, wherein each of said inner ring portions includes a seal fitting portion for fitting a labyrinth seal thereto.

5. A steam turbine jointed stationary blade as claimed in claim 1, wherein said outer ring central portion defines a plurality of seal grooves for receiving a plurality of seal fins provided on an outer end of a moving blade.

* * * * *